United States Patent [19]

Vandeweghe et al.

[11] Patent Number: 4,592,392

[45] Date of Patent: Jun. 3, 1986

[54] SHOT SEEKING MECHANISM FOR WEAVING LOOMS

[75] Inventors: Michel Vandeweghe, Heuvelland; Jan F. Derde, Ieper, both of Belgium

[73] Assignee: N.V. Weefautomaten Picanol, Ieper, Belgium

[21] Appl. No.: 710,692

[22] Filed: Mar. 11, 1985

[30] Foreign Application Priority Data

Apr. 6, 1984 [BE] Belgium ..... 2/60385

[51] Int. Cl.[4] ..... D03D 51/02

[52] U.S. Cl. ..... 139/1 E

[58] Field of Search ..... 139/1 E; 192/48.2

[56] References Cited

U.S. PATENT DOCUMENTS

| | | | |
|---|---|---|---|
| 3,175,665 | 3/1965 | Albrecht | 192/48.2 |
| 3,390,749 | 7/1968 | Pospisil | 192/48.2 |
| 4,428,404 | 1/1984 | Kleiner | 139/1 E |

FOREIGN PATENT DOCUMENTS

| | | | |
|---|---|---|---|
| 0086999A1 | 8/1983 | European Pat. Off . | |
| 2222151 | 11/1972 | Fed. Rep. of Germany . | |
| 2509665 | 9/1976 | Fed. Rep. of Germany . | |
| 2520762 | 8/1983 | France . | |
| 649032 | 8/1947 | United Kingdom | 139/1 E |

*Primary Examiner*—Henry S. Jaudon

*Attorney, Agent, or Firm*—Bacon & Thomas

[57] ABSTRACT

A shot seeking mechanism for weaving looms characterized by consisting primarily of the combination of two clutches (1 and 2), each of which is respectively constituted primarily of clutch units (5 and 6 and 7 and 8) whereby one of these clutches is placed between a drive component (3) and a driven component (4) of the main shaft of the machine, while the second clutch (2) is placed between the driven component (4) of the main shaft of the machine and an auxiliary drive motor (13).

11 Claims, 4 Drawing Figures

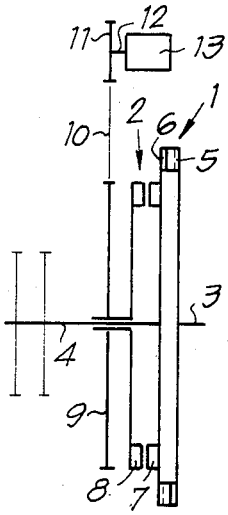
Fig. 1
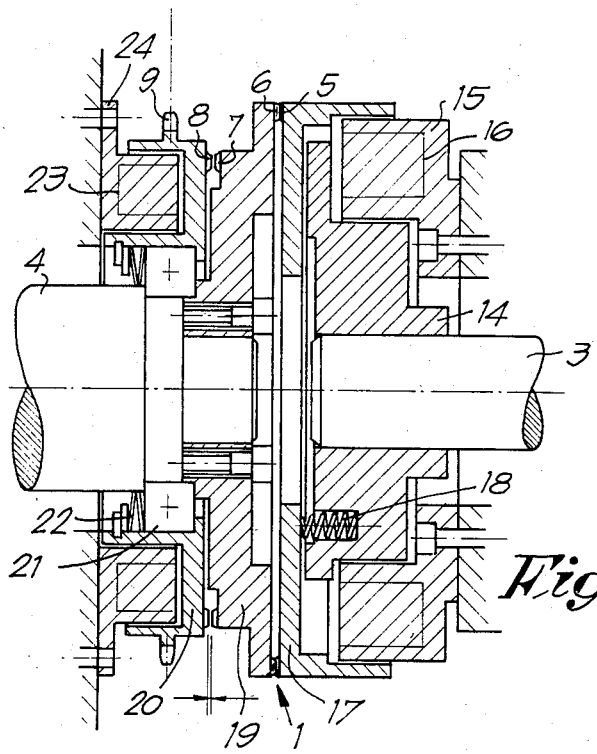
Fig. 3
Fig. 2
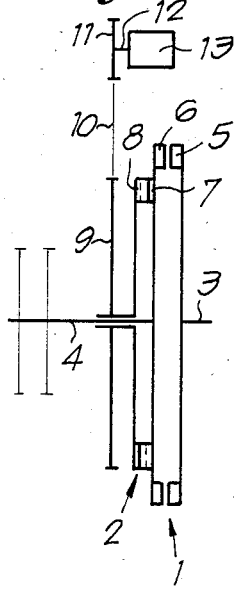
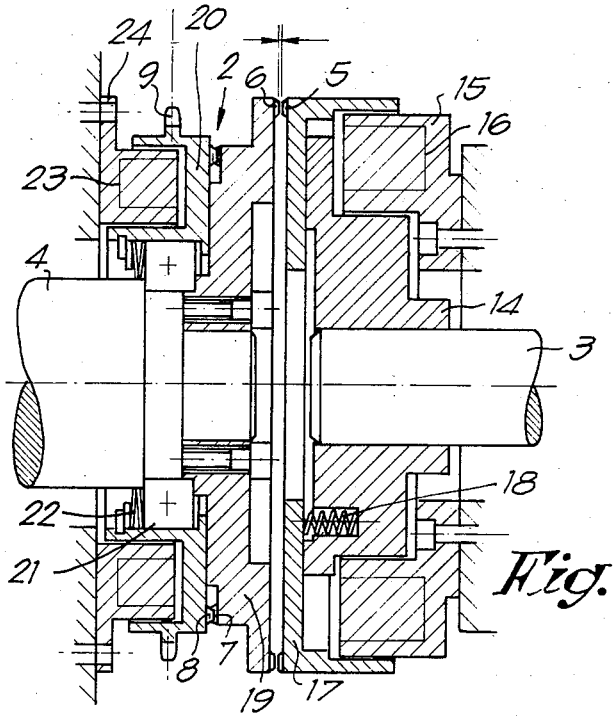
Fig. 4

SHOT SEEKING MECHANISM FOR WEAVING LOOMS

The present invention involves a shot seeking mechanism for weaving looms.

It is common knowledge that weaving looms are almost always equipped with a weft stop motion which enables faulty wefts to be detected and the machine to be stopped automatically when such a faulty weft is detected.

Since such detection generally occurs outside the actual shed itself, when high weaving speeds are being used it is impossible to stop the machine before the faulty weft is woven in, which results in the removal of such faulty wefts being relatively difficult and time-consuming, since before a new weft can be inserted, the machine has to be wound back by one shot in order to enable the faulty weft to be removed first.

This invention thus involves a shot seeking mechanism, in other words an mechanism by means of which it is possible to carry out the removal of such faulty wefts in a very simple manner and in a minimum of time.

At the same time, this mechanism as described by the invention is designed to enable it to be used to run the machine slowly forwards an/or backwards, requiring only one motor to do so.

To this end, the shot seeking mechanism for weaving looms consists primarily of the combination of two clutches, each of which is constituted primarily of clutch units whereby one of these clutches is placed between a drive component and a driven component of the main shaft of the machine, while the second clutch is placed between the driven component of the main shaft of the machine and an auxiliary drive motor.

This type of shot seeking mechanism can be used to drive any type of shed motion, i.e. a cam mechanism, a dobby mechanism, a Jacquard machine or any other drive system, which, if electromagnetic clutches are used, greatly simplifies the control and automation of the system.

In order to better demonstrate the characteristics of the invention, purely as an example and without being in any way whatsoever limiting, a preferred application design is described hereafter with reference to the accompanying drawing, in which:

FIG. 1 illustrates a schematic representation of a shot seeking mechanism as described by the invention in a normal position;

FIG. 2 is a view similar to that of FIG. 1, except that it shows a position in which certain units of the machine have been disengaged from the general drive mechanism of the machine;

FIG. 3 is a view similar to that of FIG. 1, except that it shows the design of a potential application;

FIG. 4 is a view similar to that of FIG. 1, except that it shows the disengaged position as in FIG. 2.

The shot seeking mechanism as described by the invention consists primarily of two clutches, 1 and 2 respectively, placed between the drive component 3 and the driven component 4 of the main shaft of the machine, whereby the drive component 3 of the main shaft is linked with a first component 5 of clutch 1, while the driven component 4 of the main shaft is linked simultaneously with both the second component 6 of clutch 1 and the first component 7 of clutch 2.

In this representation, the second component 8 of clutch 2 is placed so that it can rotate very freely around the aforementioned component 4 of the main shaft and is linked by a gearwheel 9 which is connected in an appropriate manner, for example by means of a chain 10, with a gearwheel 11 which is firmly attached to the shaft 12 of a motor 13.

FIG. 1 shows the position of clutches 1 and 2 during normal operation of the loom. The clutch units or parts 5 and 6 of clutch 1 engage with each other and the clutch units or parts 7 and 8 of clutch 2 are disengaged from each other. The auxiliary motor 13 is in a position of rest.

Thus at this instant component 3 of the main shaft is directly connected with component 4 via clutch 1.

When the machine stops as a result of a weft fault, components 5 and 6 of clutch 1 are disengaged from each other, while components 7 and 8 are engaged with each other as illustrated in FIG. 2.

At this moment, motor 13 is also started, thus enabling the main shaft 4 to be wound back, for example by one full revolution, after which motor 13 is stopped; components 7 and 8 of clutch 2 are once more disengaged and components 5 and 6 are once more engaged with each other.

The result of this is that when the weft is stopped, the weft end is released, so that the weaver merely has to remove the broken shot, insert the weft end into the edge of the fabric once more, and start up the machine again.

It is evident that in the same manner, by running motor 13 continuously in the appropriate direction of rotation, the machine may be run slowly forwards or backwards by engaging clutch 2 and disengaging clutch 1, which may be performed either automatically or manually.

Clutches 1 and 2 may be operated by any means whatsoever, although this should preferably be performed by electromagnetic means.

Although not limiting, the clutch components 6 and 7 should be capable of being moved independently in order to disengage clutch 1 and engage clutch 2 or vice-versa, or even to engage both clutches.

An example of an application is illustrated in FIGS. 3 and 4.

Here, a disc 14 is attached onto shaft 3 in such a way that it may rotate freely with respect to an annular disc 15, attached to the machine frame, in which magnets 16 are fitted which, when activated, attract a disc 17 against the resistance of springs 18, for which purpose component 5 of clutch 1 is fitted on disc 17.

In this application, a disc 19, fitted with component 6 of clutch 1 and component 7 of clutch 2 is attached onto shaft 4.

A very freely rotating disc 20 is mounted next to disc 19, for example by means of a ball bearing 21 whereby springs 22 attemp to hold component 8 of clutch 2 free from component 7 of this clutch.

Ultimately, disc 20 can be moved with respect to disc 19 against the resistance of springs 22 by means of magnets 23 fitted in a disc 24 attached to the machine frame.

Finally, disc 20 is made up in the form of a gearwheel.

The operation of the application as shown in FIGS. 3 and 4 may be clearly seen from FIGS. 3 and 4 based on the description of FIGS. 1 and 2.

The present invention is in no way whatsoever limited to the application described by way of an example and illustrated in the accompanying sketches, and a shot seeking mechanism as described by the invention may be produced in all types of shapes and dimensions without exceeding the scope of the invention.

We claim:

1. A clutch device for a shot seeking mechanism for weaving looms having a driven main shaft of the machine, a driving shaft and an auxiliary drive motor comprising:

(a) a first clutch support disc fixedly attached to the driven main shaft of the machine so as to rotate therewith and to be immovable in a direction along a longitudinal axis of the driven main shaft;

(b) first and second clutch means associated with the first, intermediate clutch support disc;

(c) a second clutch support disc attached to the driving shaft so as to rotate therewith and to translate in a direction along a longitudinal axis of the driving shaft;

(d) third clutch means located on the second clutch support disc;

(e) first operating means to move the second clutch support disc toward and away from the first clutch support disc so as to engage and disengage the first and third clutch means;

(f) a third clutch support disc drivingly connected to the auxiliary motor;

(g) fourth clutch means located on the third clutch support disc; and, (h) second operating means to move the third clutch support disc toward and away from the first clutch support disc so as to engage and disengage the second and fourth clutch means.

2. The clutch device according to claim 1 wherein the first and second clutch means are located on opposite sides of the first clutch support disc.

3. The clutch device according to claim 2 wherein the first clutch support disc is located between the second and third clutch support discs.

4. The clutch device according to claim 3 wherein the first operating means is a first electromagnetic control means.

5. The clutch device according to claim 4 wherein the first electromagnetic control means comprises a first stationary electromagnet structure located adjacent the second clutch support disc.

6. The clutch device according to claim 3 further comprising spring means acting on the second clutch support disc so as to bias the second clutch support disc toward the first clutch support disc.

7. The clutch device according to claim 3 wherein the second operating means is a second electromagnetic control means.

8. The clutch device according to claim 7 wherein the second electromagnetic control means comprises a second stationary electromagnet structure located adjacent the third clutch support disc.

9. The clutch device according to claim 8 further comprising second spring means acting on the third clutch support disk so as to bias the third clutch support disc away from the first clutch support disc.

10. The clutch device according to claim 3 wherein the first and third clutch means comprise members having inter-engaging teeth.

11. The clutch device according to claim 3 wherein the second and fourth clutch means comprise members having inter-engaging teeth.

* * * * *